US006543712B2

(12) United States Patent
Grimmel et al.

(10) Patent No.: US 6,543,712 B2
(45) Date of Patent: Apr. 8, 2003

(54) LAYING HEAD WITH A LAYING PIPE FOR A RAPIDLY MOVABLE WIRE ROD

(75) Inventors: Rüdiger Grimmel, Netphen (DE); Karl Keller, Hilchenbach (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/911,273

(22) Filed: Jul. 23, 2001

(65) Prior Publication Data

US 2002/0014549 A1 Feb. 7, 2002

(30) Foreign Application Priority Data

Jul. 21, 2000 (DE) ..... 100 35 532

(51) Int. Cl.[7] ..... B21C 47/10
(52) U.S. Cl. ..... 242/361; 242/361.4
(58) Field of Search ..... 242/361, 361.1–361.5

(56) References Cited

U.S. PATENT DOCUMENTS 4,036,030 A 7/1977 Papst

FOREIGN PATENT DOCUMENTS

| | | |
|---|---|---|
| EP | 0679453 | 11/1995 |
| EP | 0965396 | 12/1999 |

*Primary Examiner*—Kathy Matecki
*Assistant Examiner*—Rudiger Grimmel
(74) *Attorney, Agent, or Firm*—Sidley Austin Brown & Wood, LLP

(57) ABSTRACT

A laying head for a rapidly movable wire rod and including a carrying sleeve located in the support housing of the laying head for receiving a wire entrance section of a laying pipe and supported by two, spaced from each other bearings, a pipe holder projecting past an end surface of the carrying sleeve remote from a carrying sleeve section that receives the wire entrance section of the laying pipe for supporting a wire laying section of the laying pipe; and a pressing device located in the support housing for applying a radial pressure to a section of the carrying sleeve located between the two bearings.

1 Claim, 1 Drawing Sheet

LAYING HEAD WITH A LAYING PIPE FOR A RAPIDLY MOVABLE WIRE ROD

BACKGROUND OF THE INVENTION

1. Field of the Invention

The present invention relates to a laying head with laying pipe for a rapidly movable wire rod and including a support housing, a carrying sleeve located in the support housing for receiving a wire entrance section of a laying pipe, two, spaced from each other bearings secured in the support housing for supporting the carrying sleeve; a pipe holder projecting past an end surface of the carrying sleeve remote from a carrying sleeve section that receives the wire entrance section of the laying pipe, for supporting a wire laying section of the laying pipe.

2. Description of the Prior Art

With the laying heads of a type described above, a wire rod, which is fed from a wire rolling train and moves with a high speed, enters a wire entrance section of the laying pipe, which is located in the axial region of the carrying sleeve, and is guided toward the laying section of the laying pipe which is radially spaced from the central axis of the carrying sleeve and is formed as a circular section. The wire rod, upon exiting the mouth of the circular section, falls in form of coils on a further conveyor. The above described laying head is disclosed in European Publication EP-A2 965 396 and EP-A1 679 453.

Because the wire rod is fed from modem wire rolling trains with a high speed, the laying head should likewise be driven with a high speed. Therefore, the laying pipe, which transforms the linearly movable wire rod in circular windings or coils, should be held by the pipe holder in as stable position as possible. It is to be noted in particular that the specific guide profile of the laying head leads to concentration of circulating masses at the most remote from the carrying sleeve, overhanging section of the pipe holder.

With this design which, as a rule, includes a radial bearing as a movable bearing and a stationary bearing, the overhanging of the pipe holder causes a essentially permanent deflection of the carrying sleeve in the space between the two bearings, which is associated with a run-out resulting from the circulation of the wire rod. Both these phenomena lead during the operation of the laying head, as a result of a high and constantly increasing rolling speed of the wire rolling train, to critical whirling speeds which, if exceeding a certain value, can cause dangerous pendulum swingings of the pipe holder and the laying pipe, which also can cause frequent circular movements of the bearings and the bearing fatigue.

Accordingly, an object of the present invention is to eliminate the drawbacks of the conventional laying head and, in particular, the phenomena associated with the pendulum swinging of the pipe holder and the laying pipe.

SUMMARY OF THE INVENTION

This and other objects of the present invention, which will become apparent hereinafter, are achieved by providing in the laying head housing a pressing device for applying a radial pressure to the section of the carrying sleeve located between the two bearings.

According to one embodiment of the present invention, the pressing device includes a bearer with a plurality of pressing rollers that engage the cylindrical section of the carrying sleeve, applying pressure thereto. The bearer is displaced in a radial direction, transverse to the axis of the carrying sleeve, by spring, electrical, or hydromechanical means.

According to a further embodiment of the present invention, the pressing device includes a pressure bush which surrounds the cylindrical section of the carrying sleeve, applying pressure thereto. The bush applies to the sleeve section an adjustable, vertically directed hydrostatic and/or hydromechanical pressure. The pressure bush can be formed with a per se known conically extending inner surface so that the bush can be axially displaced over the sleeve section to properly position, in the axial direction, the application point of the pressure.

According to a still further embodiment of the present invention, the pressing device includes a magnetic bearing that surrounds the cylindrical section of the carrying sleeve. The direction and the amount of the magnetic forces the magnets of the magnet bearing apply to the sleeve section are adjustable.

The pressing device can also be formed of an axially adjustably displaceable slide bearing that applies a radial pressure to the sleeve section.

Providing of the pressing device permits to eliminate an undesirable additional loading of the carrying sleeve supporting bearings, in particular of the bearing that adjoins the pipe holder. In additional, the pressuring device permits to substantially reduce the swinging level of the pipe holder and the laying pipe and insures a disturbance-free operation even if the rolling speed of the wire rolling would increase still further.

The novel features of the present invention, which are considered as characteristic for the invention, are set forth in the appended claims. The invention itself, however, both as to is construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
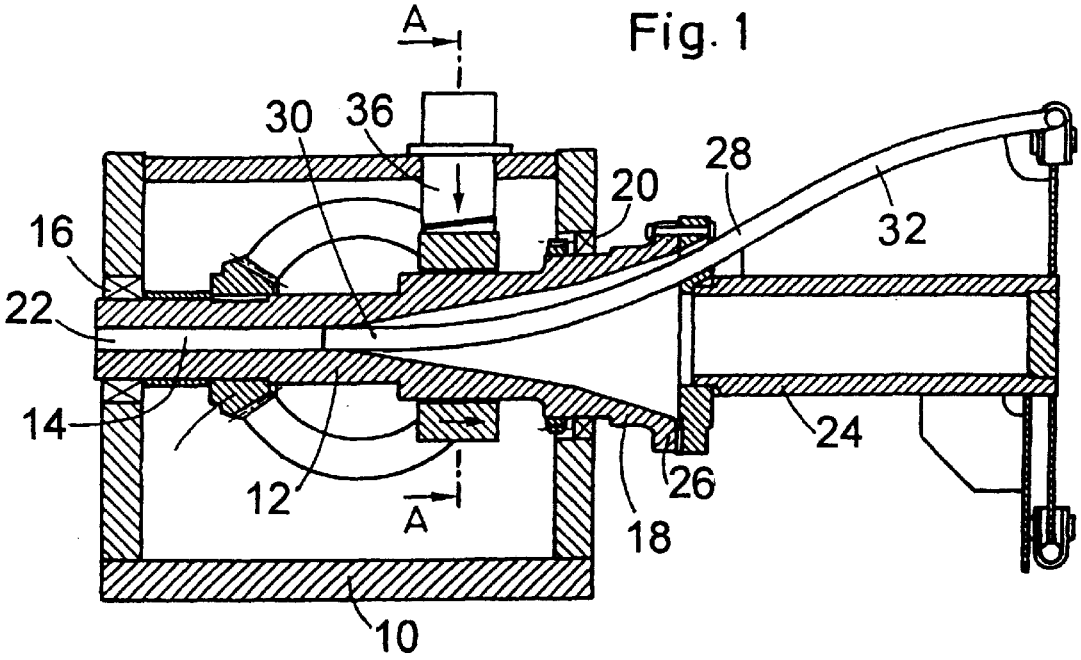
FIG. 1 a cross-sectional side view of a laying head according to the present invention.

A laying head according to the present invention, which is shown in FIG. 1, includes a support housing 10 in which there is arranged a carrying sleeve 12. The carrying sleeve 12 has a cylindrical section 14 which is supported in an entrance bearing 16, and a conical section 18 which is supported in a main bearing 20. The cylindrical section 14 of the carrying sleeve 12 has a central passage 22 for a wire rod fed from a wire rolling train (not shown). A pipe holder 24 is flange-mounted on the end portion 26 of the conical section 18 of the carrying sleeve 12 for supporting of laying pipe 28. The laying pipe 28 has its wire entrance section 30 connected with the wire entrance passage 22, with the wire laying section 32 of the laying pipe 28 being supported by the pipe holder 24.

The rotation of the carrying sleeve 12 is effected with a bevel gear drive 34. The support housing 10 support a pressing device 36 that acts on a portion of the cylindrical section 14 of the carrying sleeve 12.

Figure 2:
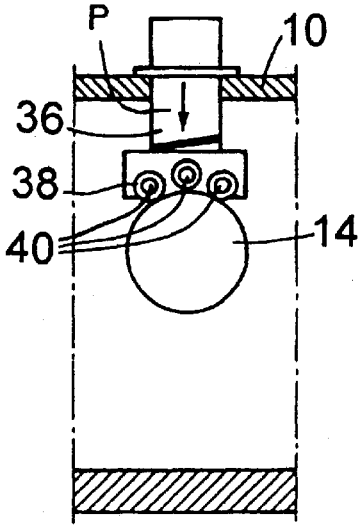
FIG. 2 a cross-sectional view along line A—A FIG. 1.

The pressing device 36, as shown in FIG. 2, includes a bearer 38 displaceable in a direction, which is shown with arrow P, toward the cylindrical section 14 of the carrying sleeve 12, applying pressure to the cylindrical section 14. The bearer 38 displaced by spring means (not shown) or electromechanical or electrohydraulic means (likewise not shown). The pressure is applied to the cylindrical section 14 with pressing rollers 40.

Figure 3:
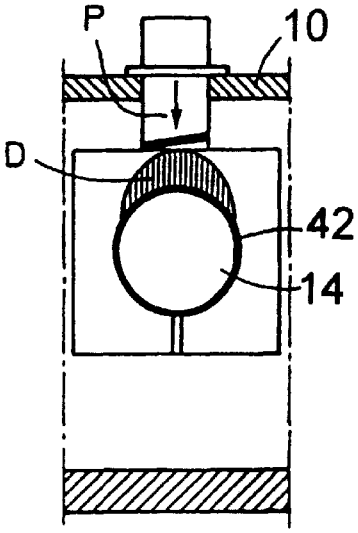
FIG. 3 a cross-sectional view similar to that of FIG. 2 of another embodiment of the pressing device than that shown in FIG. 2.

In the embodiment of a pressing device 36 shown in FIG. 3, the pressure is applied to the cylindrical section 14 with a pressure bush 42 that surrounds the cylindrical section 14. An adjustable, vertically directed, hydromechanical or hydrostatic pressure is built up in the bush 42. The distribution of the pressure is illustrated by diagram D.

Figure 4:
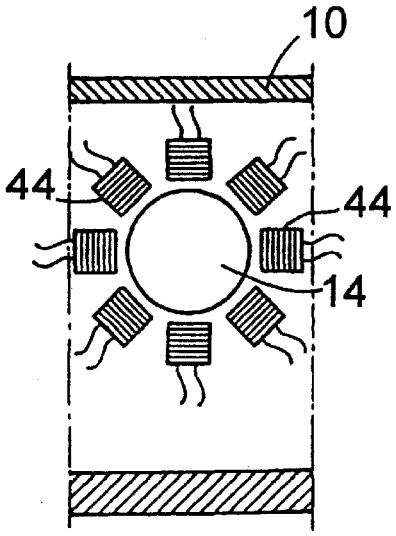
FIG. 4 a cross-sectional view similar to that of FIG. 2 of a further embodiment of a pressing device.

In the embodiment of FIG. 4, the cylindrical section 14 of the carrying sleeve 12 is surrounded by a magnetic bearing 44 which applies a magnetic force the direction and amount of which can be controlled.

Though the present invention was shown and described with references to the preferred embodiments, such are merely illustrative of the present invention and are not to be construed as a limitation thereof, and various modifications of the present invention will be apparent to those skilled in the art. It is, therefore not intended that the present invention be limited to the disclosed embodiments or details thereof, and the present invention includes all variations and/or alternative embodiments within the spirit and scope of the present invention as defined by the appended claims.

What is claimed is:

1. A laying head for a rapidly movable wire rod, comprising a support housing; a carrying sleeve located in the support housing for receiving a wire entrance section of a laying pipe; two, spaced from each other bearings secured in the support housing for supporting the carrying sleeve; a pipe holder projecting past an end surface of the carrying sleeve remote from a carrying sleeve section that receives the wire entrance section of the laying pipe, for supporting a wire laying section of the laying pipe; and a pressing device located in the support housing for applying a radial pressure to a section of the carrying sleeve located between the two bearings, wherein the pressing device comprises a bearer displaceable in a radial direction and including a plurality of pressing rollers for applying pressure to the sleeve section located between the two bearings.

* * * * *